United States Patent [19]

Paterick

[11] Patent Number: 4,821,391

[45] Date of Patent: Apr. 18, 1989

[54] MACHINE FOR FORMING AUTOMOTIVE MUFFLER MECHANICAL LOCK JOINT

[75] Inventor: Robert J. Paterick, Knoxville, Tenn.

[73] Assignee: Maremont Corporation, Carol Stream, Ill.

[21] Appl. No.: 873,799

[22] Filed: Jun. 13, 1986

[51] Int. Cl.[4] ..... B23P 19/04

[52] U.S. Cl. ..... 29/253; 72/393; 29/251; 29/263; 29/282

[58] Field of Search ..... 29/243.5, 251, 252, 29/253, 263, 282; 72/355, 393

[56] References Cited

U.S. PATENT DOCUMENTS

| | | | |
|---|---|---|---|
| 1,039,948 | 10/1912 | Hunter | 29/253 |
| 1,610,796 | 12/1926 | King | 72/393 |
| 3,283,699 | 11/1966 | Hawkins | 29/251 |

*Primary Examiner*—Robert P. Olszewski

*Assistant Examiner*—Judy J. Hartman

*Attorney, Agent, or Firm*—McAndrews, Held & Malloy, Ltd.

[57] ABSTRACT

An apparatus for forming a muffler mechanical lock joint, and the resulting assembly. An end panel is loaded in a die structure. Die segments on chuck jaws hold an end panel flange. A tube is loaded over a wedge, punch segments, a punch segment holder, barrel and wedge drive rod. The panel, chuck and die structure are driven over the tube. Each punch segment includes a protrusion punch and a bead punch segment. The wedge is axially pulled. Guiding and guided members on the punch segments and segment holder allow only radial movement of the segments. Axial pulling of the wedge thereby causes radial expansion of the punch segments. The radially expanded punch segments form a plurality of protrusions in the tube and panel flange, and an adjacent bead.

11 Claims, 9 Drawing Sheets

FIG. 7
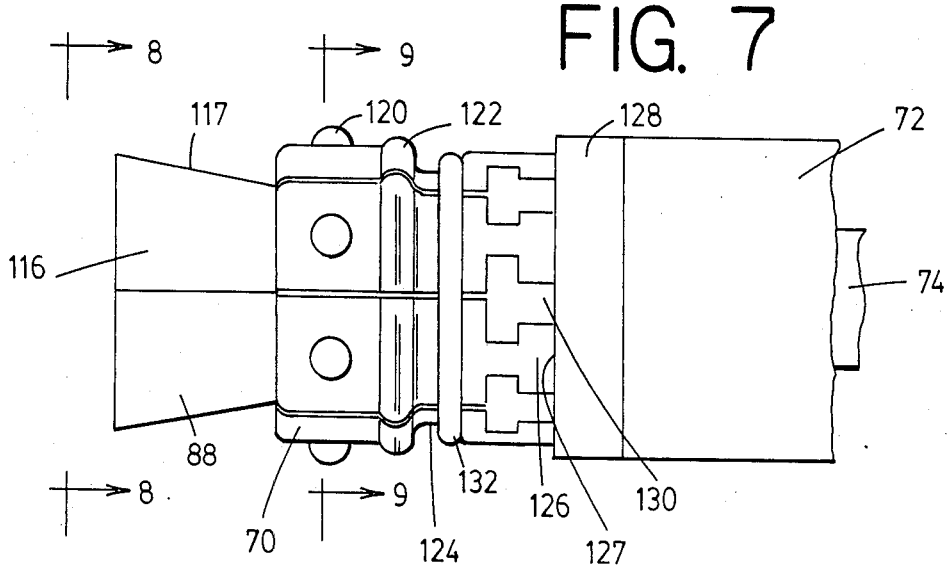
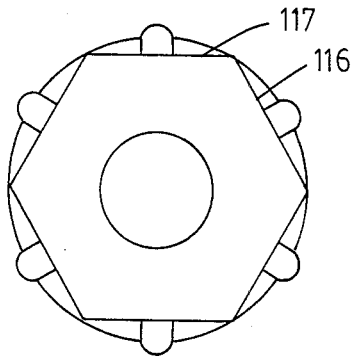
FIG. 8
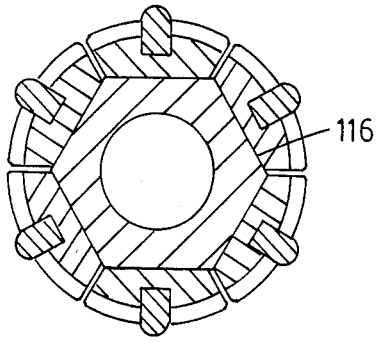
FIG. 9

MACHINE FOR FORMING AUTOMOTIVE MUFFLER MECHANICAL LOCK JOINT

BACKGROUND OF THE INVENTION

This invention relates to automotive muffler forming machinery, and more particularly to a machine for deforming tubular muffler components into a mechanically joined muffler subassembly. The invention also relates to a process of forming a mechanically joined muffler subassembly, and the assembly as formed by the inventive process.

Focusing on the formation of automotive mufflers, mechanical lock joints have been invented which mechanically join muffler components in superior fashion. U.S. Pat. No. 4,565,260 issued on Jan. 21, 1986 to Wayne Scheidt et al. discloses such an invented joint. A mechanical lock joint is superior in its ease of inspection, maintenance of internal structure of the component materials, maintenance of continuity of protective coatings, ease of handling, lack of material distortion and the like. Nevertheless, serious problems have attended the formation of such lock joints in the accuracy of the joint forming machinery, the energy required, the longevity of the machine, and the ease and speed of maintenance, among others.

SUMMARY OF THE INVENTION

In a principal aspect, this invention comprises machinery for the formation of mechanical lock joints in muffler components, such as the joint shown in U.S. Pat. No. 4,565,260, incorporated by reference. The machinery comprises, in part, a punch means, a wedge means, a drive means, and a return means. The punch means is radially expandable and provides for deforming a flange and tube of muffler components into a mechanical lock joint, while the punch means is radially expanded. The wedge means is axially movable, and wedges the punch means into radial expansion when axially moved. The drive means intermittently axially moves the wedge means to wedge the punch means, and the return means returns the punch means from radial expansion.

The foregoing means are, in another principal aspect of the invention, embodied in semi-automatic machinery including an automated punch and automated die. In still other principal aspects, the invention comprises the method of operation of the machinery upon the muffler components, and the muffler subassembly resulting from the machine operation.

Advantages of the invention include uniformly reliable mechanical lock joints, ease of formation, high speed formation, ease of maintenance and the like. These and other objects, aspects and advantages of the invention are best appreciated by a study of a detailed description of the preferred embodiment of the invention, which follows.

BRIEF DESCRIPTION OF THE DRAWING

The accompanying drawing includes eighteen figures. These figures are as follows:

FIG. 7 is an enlarged elevation view of the punch structure of the preferred machine;

FIG. 8 is an end view of the punch structure of the preferred machine;

FIG. 9 is a cross-section view of the punch structure of the preferred machine, taken along line 9—9 in FIG. 7;

DETAILED DESCRIPTION OF THE PREFERRED EMBODIMENT

Figure 1:
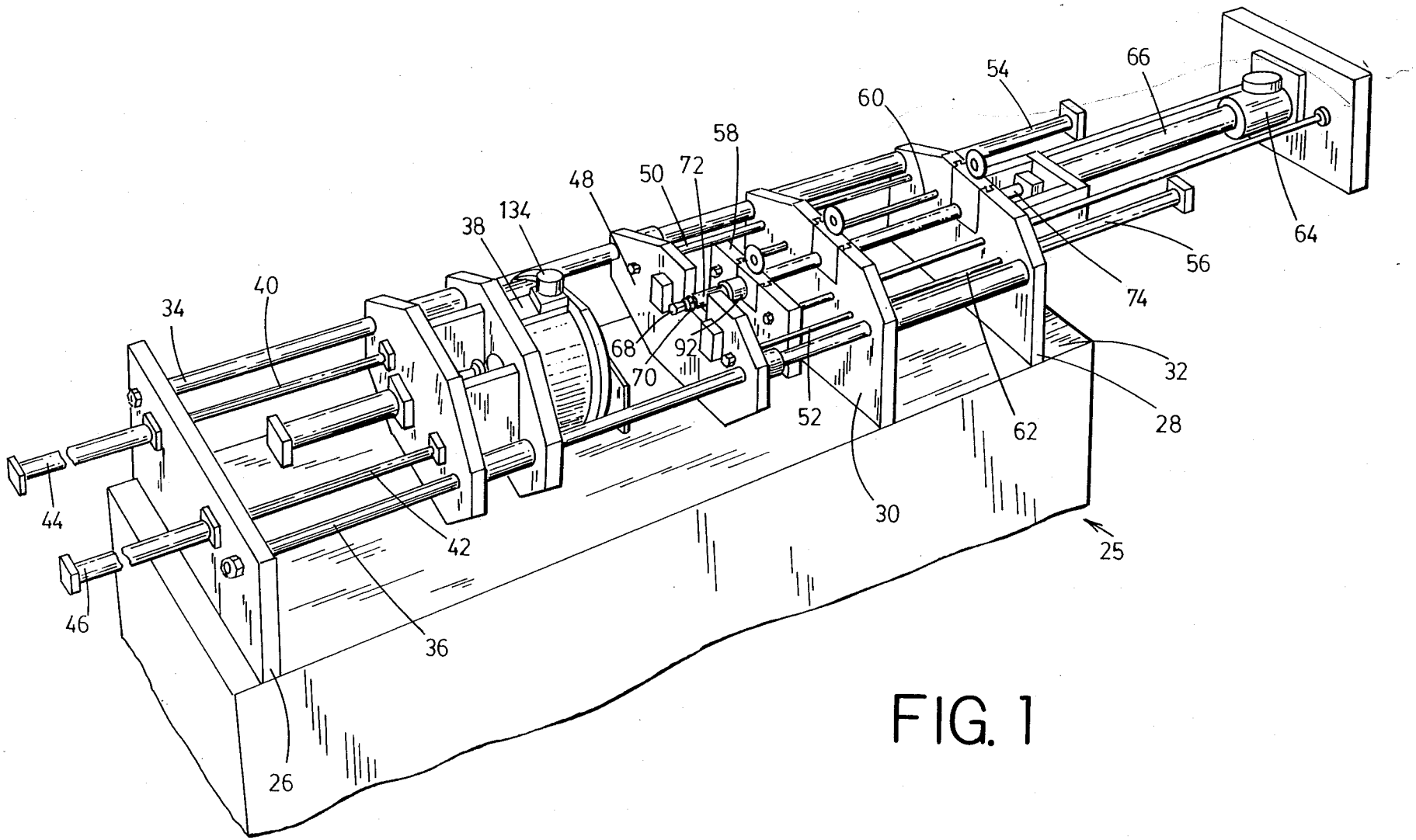
FIG. 1 is a perspective view of the preferred embodiment of the invention, which is a semi-automated machine, with hydraulic lines and similar control elements removed to expose greater detail, and with the machine in an open condition.

Referring to FIG. 1, the preferred embodiment of the present invention is an apparatus, or more specifically, a semi-automated machine generally referenced 25. Two upright end plates 26, 28 and an upright intermediate plate 30 are supported atop a base 32. A pair of fixed ways, or polished, parallel, tubular steel members 34, 36 are supported by the plates 26, 28, 30, and support a moving die and workpiece holding structure generally 38. The structure 38 is reciprocated along the ways 34, 36 by rods 40, 42 of two drive cylinders 44, 46. The ways 34, 36 also support a movable workpiece positioning plate 48 which is reciprocated by the rods 50, 52 of two drive cylinders 54, 56. A second adjustable workpiece positioner 58 is mounted on two rods 60, 62 and its position adjusted by a jack screw 64 suspended along a fixed jack screw mounting rod 66. A punch structure 68 includes radially expandable punch segments 70 mounted at the end of a non-moving barrel 72. A wedge drive rod 74 extends though the barrel to a wedge (88, FIG. 2) and is reciprocated to operate the punch segments.

Figure 3:
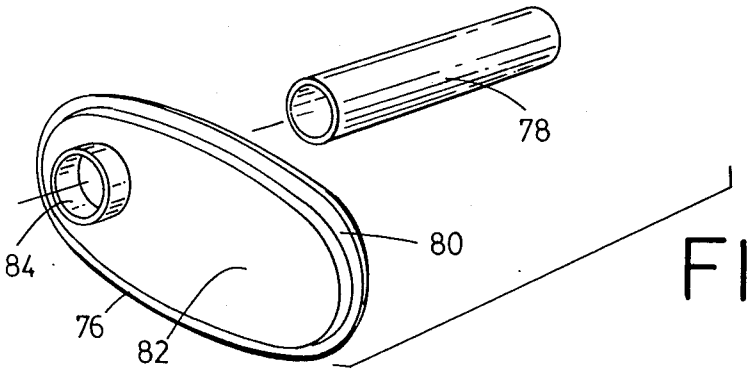
FIG. 3 is a perspective view of the two muffler components which are the workpiece components formed in the preferred machine.

Referring to FIG. 3, the workpieces upon which the machine 25 functions each include a first workpiece component, a muffler end panel 76, and a second workpiece component, a muffler tube 78. The panel 76 includes a rim 80, a planar central portion 82, and a flange 84 perpendicular to the central portion 82. The internal diameter of the flange 84 is equal to the outer diameter of the tube 78.

Figure 5:
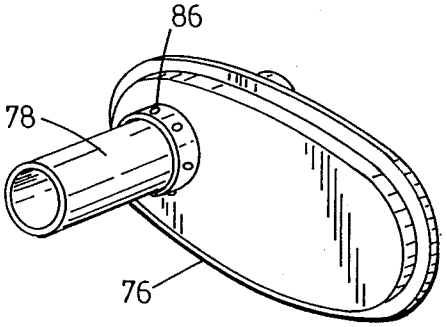
FIG. 5 is a perspective view of the muffler components of FIG. 3 as formed together in the preferred machine.
Figure 17:
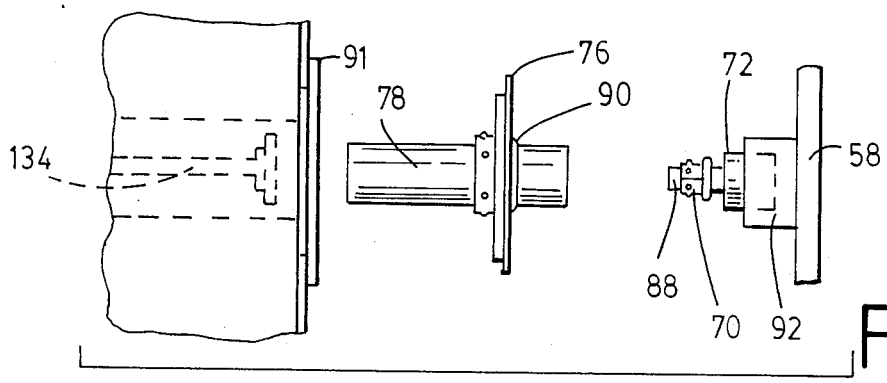

Comparing FIG. 5 to FIG. 3, the function of the machine 25 is to join the panel 76 to the tube 78 to form a mechanically locked muffler subassembly. The mechanical lock joint of the subassembly includes a plurality of protrusions such as 86 formed in the flange 84 and tube 78 adjacent the shoulder where the end panel flange meets the end panel central portion. Referring to FIG. 17, the mechanical lock joint also includes a bead 90, which is a ring or localized, annular, radially outwardly extending enlargement of the tube 78.

Figure 2:
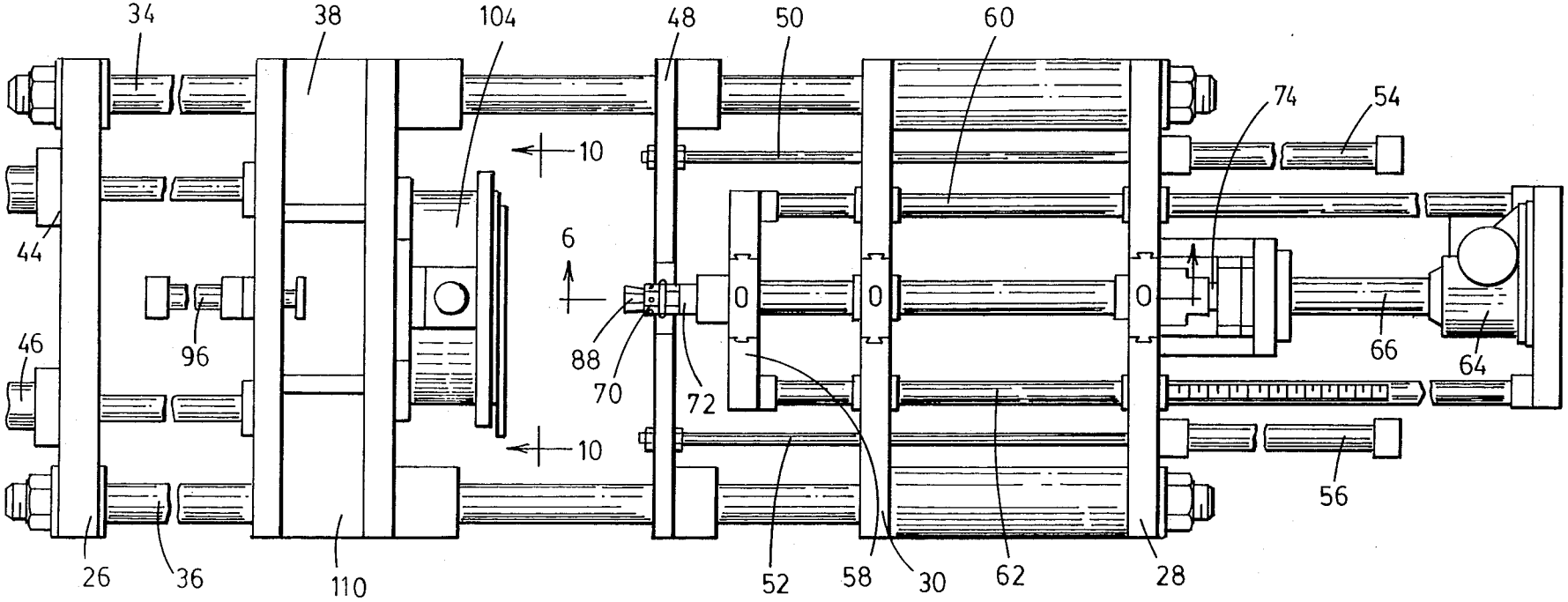
FIG. 2 is a top or plan view of the machine of FIG. 1.
Figure 13:
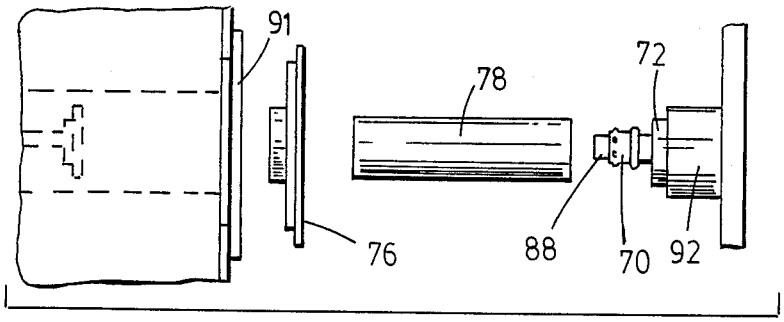
FIGS. 13–17 are a series of schematic views of the punch and die structure of the preferred machine, illustrating movement of a workpiece through the machine.

The machine 25 forms the subassembly of FIG. 5 from the components of FIG. 3 beginning with the machine in an open or ready condition as in FIGS. 1, 2 and 13. In this condition, the die and workpiece holding structure (hereafter "the die structure") 38 is remote from the punch structure 68. The die structure 38 is in a retracted position. A space is open between the die structure and punch structure for manual insertion of an end panel 76 and tube 78.

Referring again to FIG. 2, in the machine open condition, the first workpiece positioning plate 48 is moved to an advanced position, projecting toward the die structure 38. Also, the wedge drive rod 74 and wedge 88 are in non-engaging positions, moved toward the die structure 38.

Figure 12:
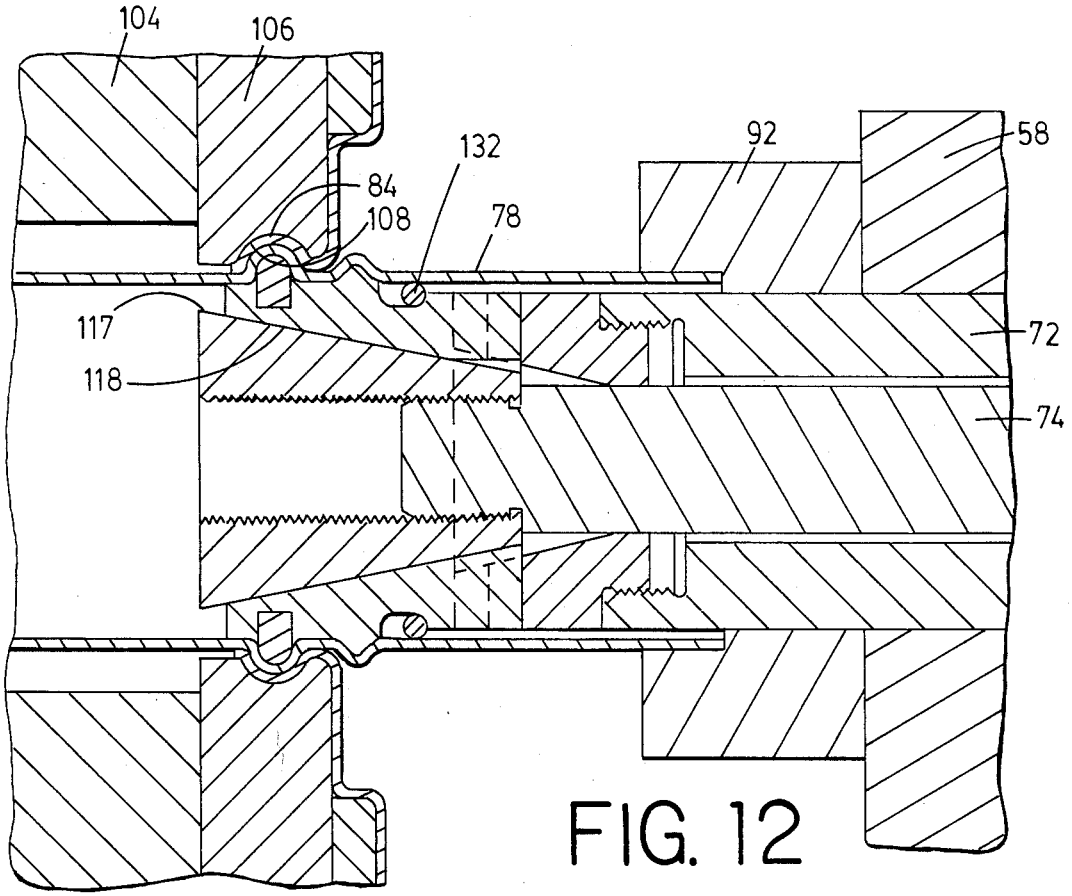
FIG. 12 is a cross-section, detail view of the punch and die structure of the preferred machine, taken along line 11,12—11,12 in FIG. 4, with the punch in engaged position.
Figure 14:
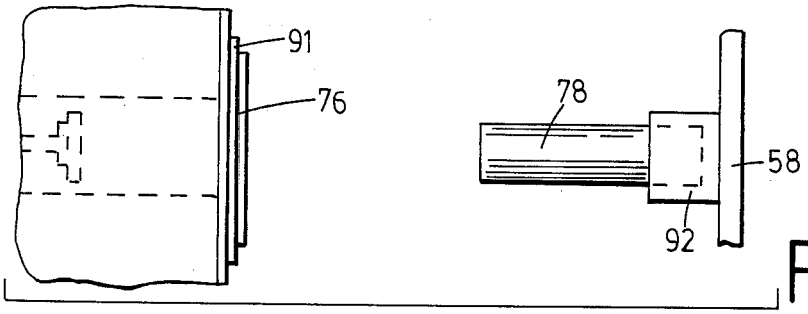

The end panel 76 and tube 78 are loaded as in FIGS. 13 and 14. The end panel 76 is placed on the die structure 38, flange in. The end panel rim 80 is engaged by a rim receptor 91, as in FIG. 12. The tube is placed over the wedge 88, punch segments 70 and barrel 72, within a tube receptor 92 of the second workpiece positioner 58.

Figure 18:
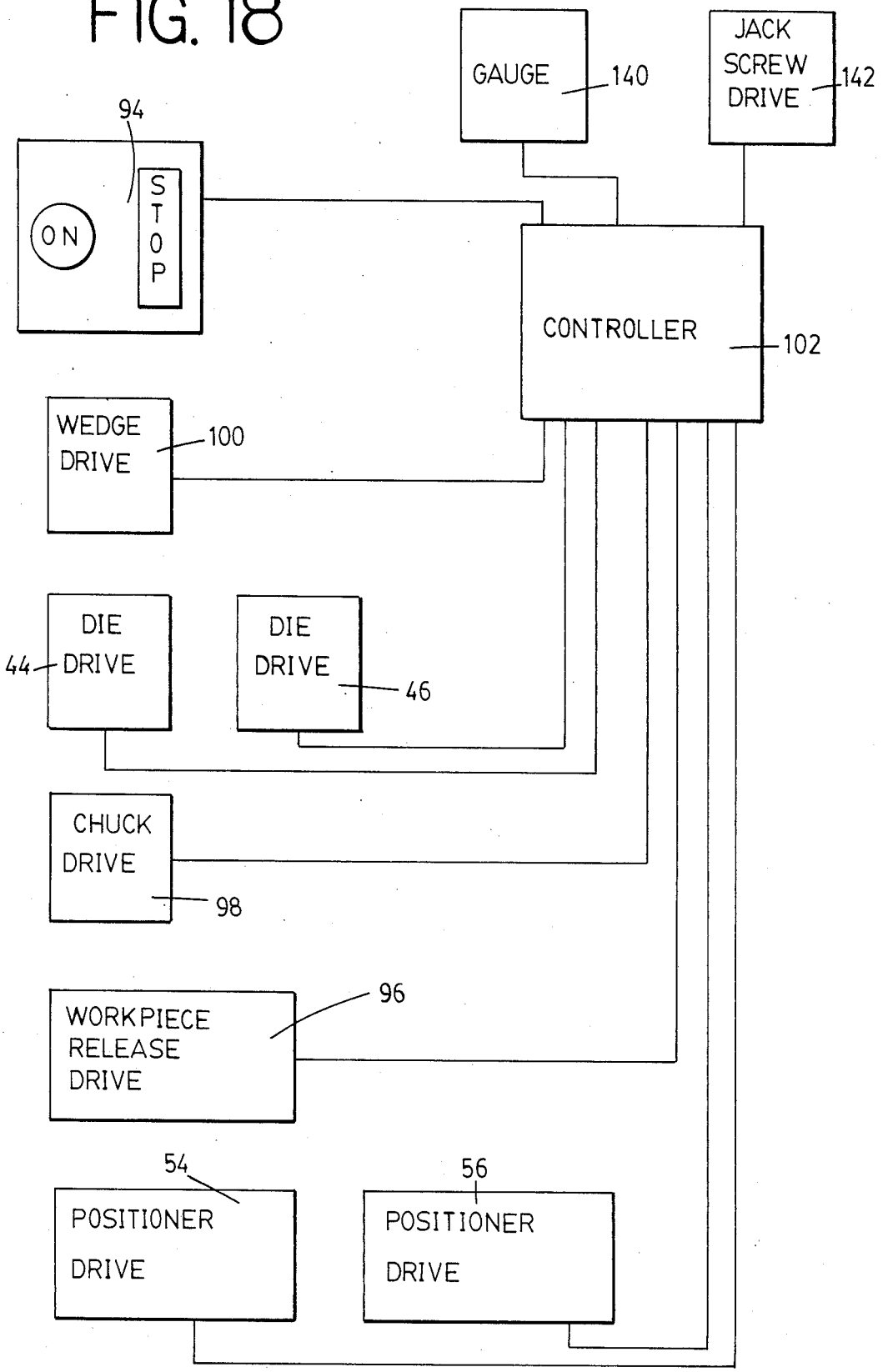
FIG. 18 is a schematic view of the control of the preferred machine.

The machine progresses toward joint formation upon removal of operator hands and actuation via control panel 94, as in FIG. 18. Electrical and hydraulic lines operatively connect the panel 94, the drive elements previously identified (drive cylinders 44, 46, 54, 56), a workpiece release drive (a drive cylinder 96, FIG. 2), a chuck drive 98, and a wedge drive 100 through a controller 102. The controller 102 includes such hydraulic drive elements as solenoid valves, a fluid reservoir and a pump.

Figure 10:
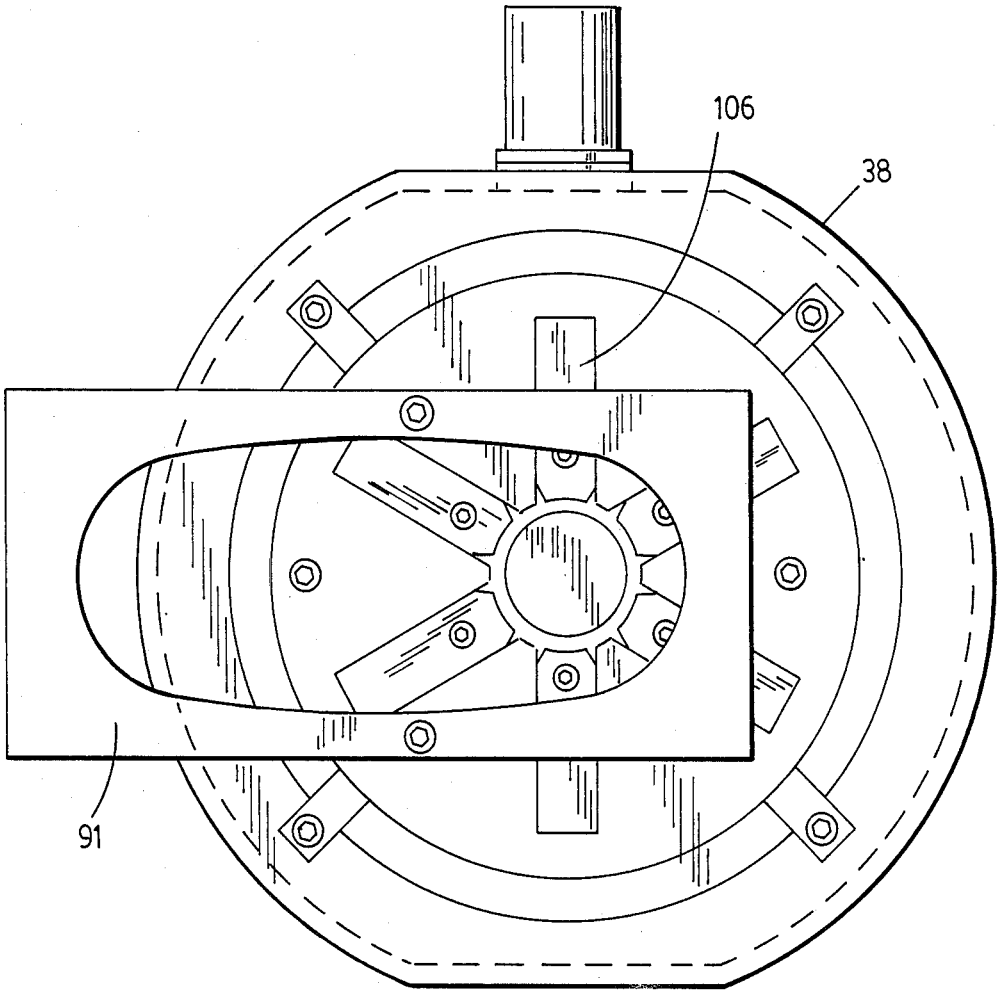
FIG. 10 is a cross-section view of the punch structure of the preferred machine, taken along line 10—10 of FIG. 7.
Figure 11:
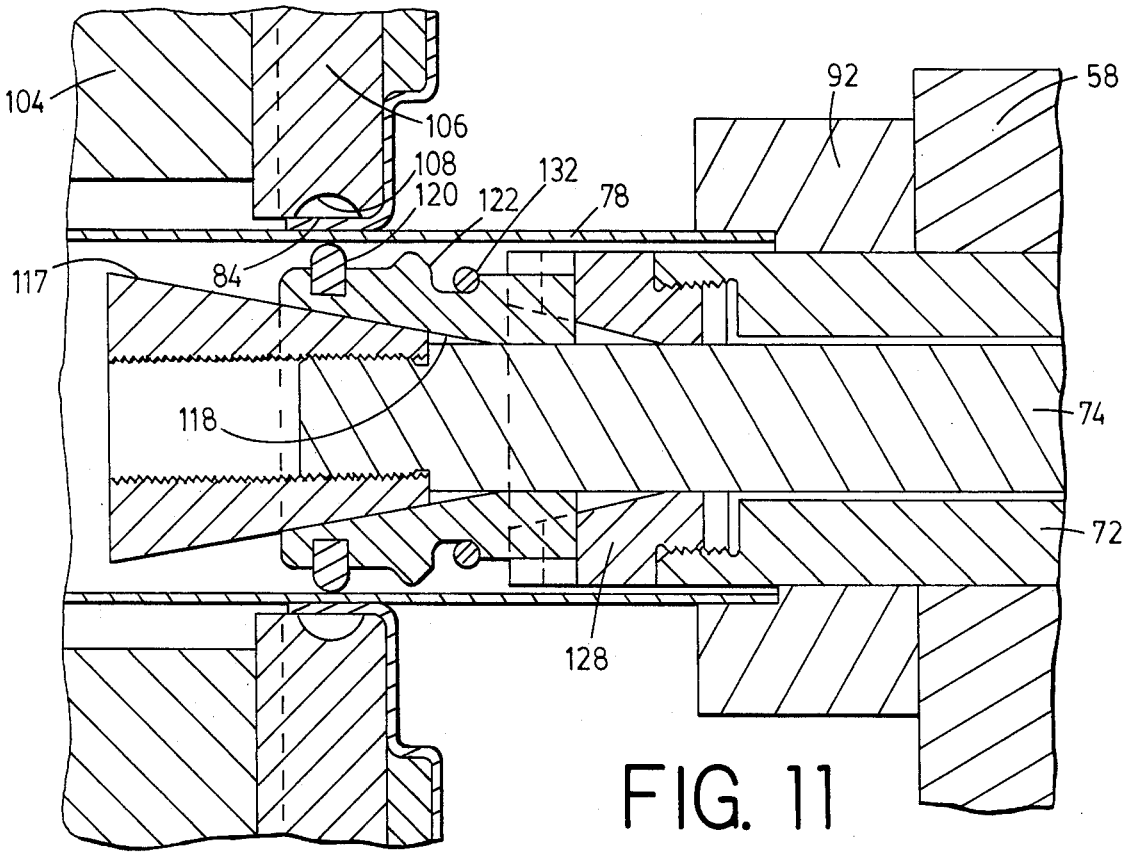
FIG. 11 is a cross-section, detail view of the punch and die structure of the preferred machine in closed position, taken along line 11,12—11,12 in FIG. 4, with the punch in non-engaged position.
Figure 15:
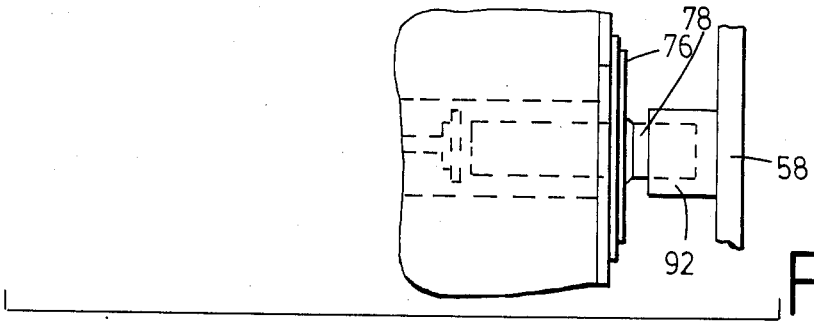
Figure 16:
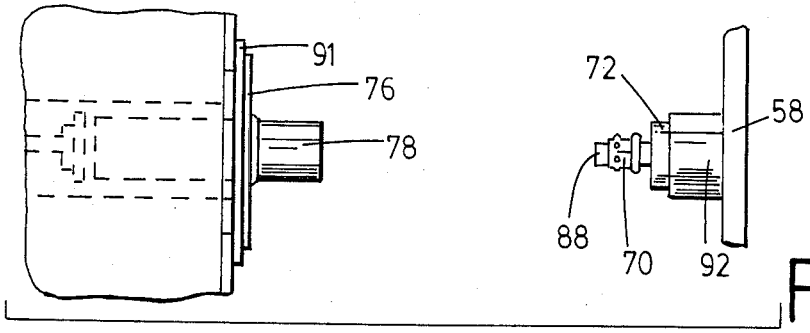

The chuck drive 98 is attached to a chuck 104, FIG. 2, of the die structure 38. Actuation of the machine 25 causes the chuck drive 98 to drive a chuck such as 106, FIGS. 10 and 11, containing die segments such as 108, FIGS. 12 and 13, into light gripping contact with the end panel flange 84. The chuck, mounted to a chuck carrier 110, FIG. 2, on the ways 34, 36, is then driven toward the tube and the punch structure. The end panel central portion 82 is driven into contact with pads 112, 114, FIG. 4, on the movable workpiece positioning plate 48. The pads aid in holding the end panel properly positioned during joint formation. Continued movement of the chuck pushes the plate 48, until the chuck motion automatically ceases with the end panel flange 84 along and around the tube 78, as in FIGS. 4, 11 and 15.

The wedge drive 100 then pulls the wedge drive rod 74, to the right as in FIGS. 11–17. Comparing FIG. 12 to FIG. 11, the wedge drive rod 74 pulls the wedge 88.

Referring to FIGS. 7–9, the wedge 88 includes a plurality, preferably six, of wedge faces in the form of flats such as flats 116, 117. Each flat is axially sloped, i.e., has a surface with points at varied distances from the central axis of the wedge and wedge drive rod. Each punch segment 70 has a wedged face such as 118 adjacent a wedge face and also axially sloped. The wedged faces ride on the wedge faces.

Each punch segment also includes a segment of the punch formed by the punch segments. As in FIG. 7, each segment of the punch includes a protrusion punch 120 and a bead segment punch 122.

Across a recess 124 from the punches 120, 122, each punch segment 70 also includes a guided member in the form of a finger such as a tee flange 126. The tee flange 126 is fitted in a tee flange slot 127. Tee flange slots such as 127 are formed in a segment holder 128 screwed on the barrel 72. The tee flange slots are formed between mating tee flanges such as 130 in the holder 128. The tee flanges 126 are movable in the slots radially, and radially only. A spring 132 fitted around the punch segments 70 in the recess 124 holds the segments to each other and against the wedge 88.

Returning to machine operation, the wedge 88, when pulled, engages the punch segments 70, forcing them radially outward. The wedged faces of the punch segments bear on the wedge faces as the wedge moves by. The tee flanges and slots prevent the punch segments from moving axially and force their movement to occur radially.

As the punch segments drive outward, their protrusion punches 120 and bead segments 122 contact the tube 78. As in FIG. 12, continued movement of the wedge 88 drives the punch segments 70 to deform the tube 78 to the end panel flange against the die segments 104.

The mechanical lock joint of the end panel and flange is so formed. The wedge drive rod is returned to a non-engaging position, and the chuck 104 is retracted. The tube, joined to the end panel, moves with the end panel on the chuck, as in FIG. 16. The punch segments, under the action of the spring 132, return to their retracted positions, where they continue to bear on the wedge 88. The chuck jaws are retracted. A workpiece release rod 135, as in FIGS. 4 and 17, then pushes the end panel and tube subassembly from the chuck into a bin waiting below the machine 25.

The structure and function of the machine 25 are substantially completely described. Three components deserve further attention. First, the chuck 104 comprises a chuck of the Buck Chuck Company, Kalamazoo, Mich., modified to include the die segments 108 on its jaws 106. The chuck is also modified for automatic operation by inclusion of the chuck drive 98 and a jaw stop member 134, FIGS. 1 and 4. The chuck drive is a hydraulic motor attached to the chuck pinion. The jaw stop member 134 is an element on the chuck body which rides in the grooves of the internal chuck scroll (not shown) through a chuck body opening. When the jaw stop member bottoms out by contact with the chuck body, the chuck scroll is locked against further movement, which in turn locks the jaws.

The jack screw is on a fixed rod 66 as stated, and movable therealong. A gauge 140, FIG. 18, provides for manual adjustment of the position of the jack screw 64 along the rod 66 via controller 102 and a jack screw drive 142. Movement of the jack screw 64 along the rod 66 adjusts the position of the rods 60, 62, FIG. 1, and the second workpiece positioner 58. The position of the positioner controls the position of the tubes 78 loaded in the machine, and thereby controls the position of the joint of the tube with the end flange. As a result, an operator can adjust the position of the joint along the tube for varying job requirements, and for precision.

Figure 4:
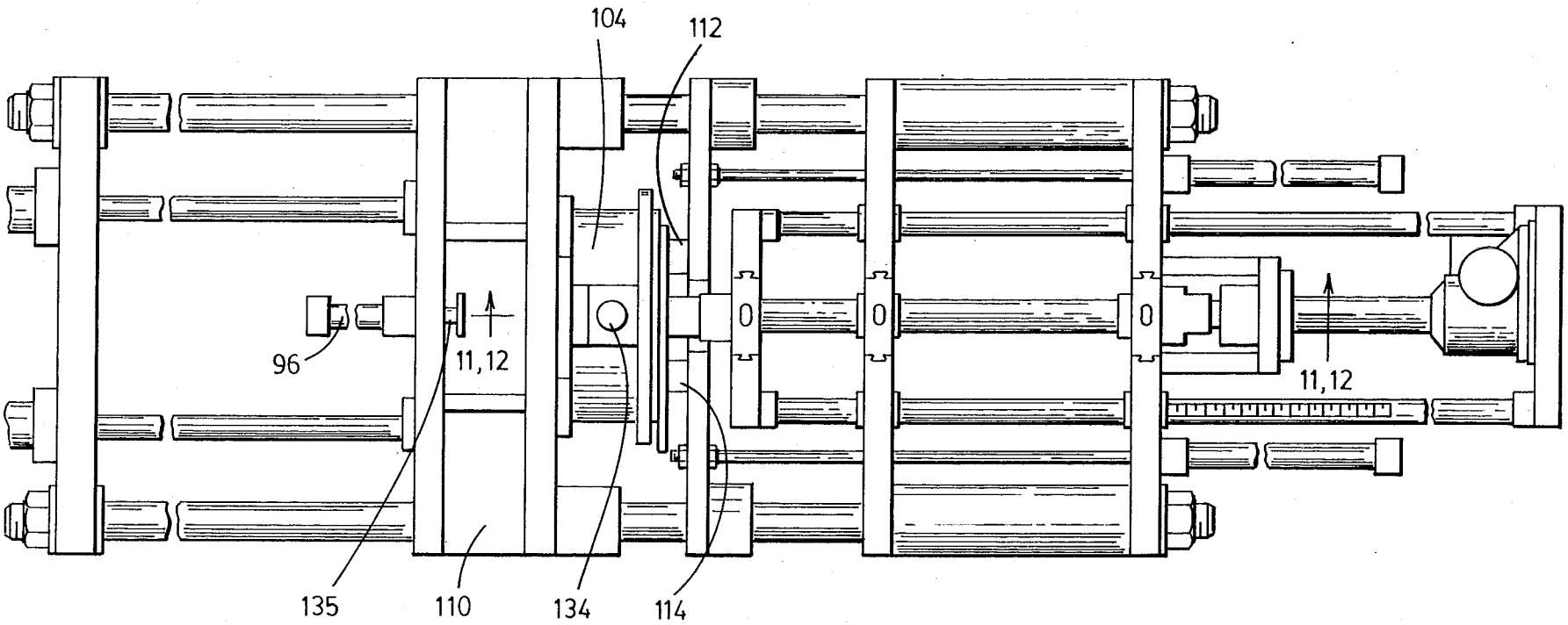
FIG. 4 is a plan view similar to FIG. 1 with the machine in closed position.
Figure 6:
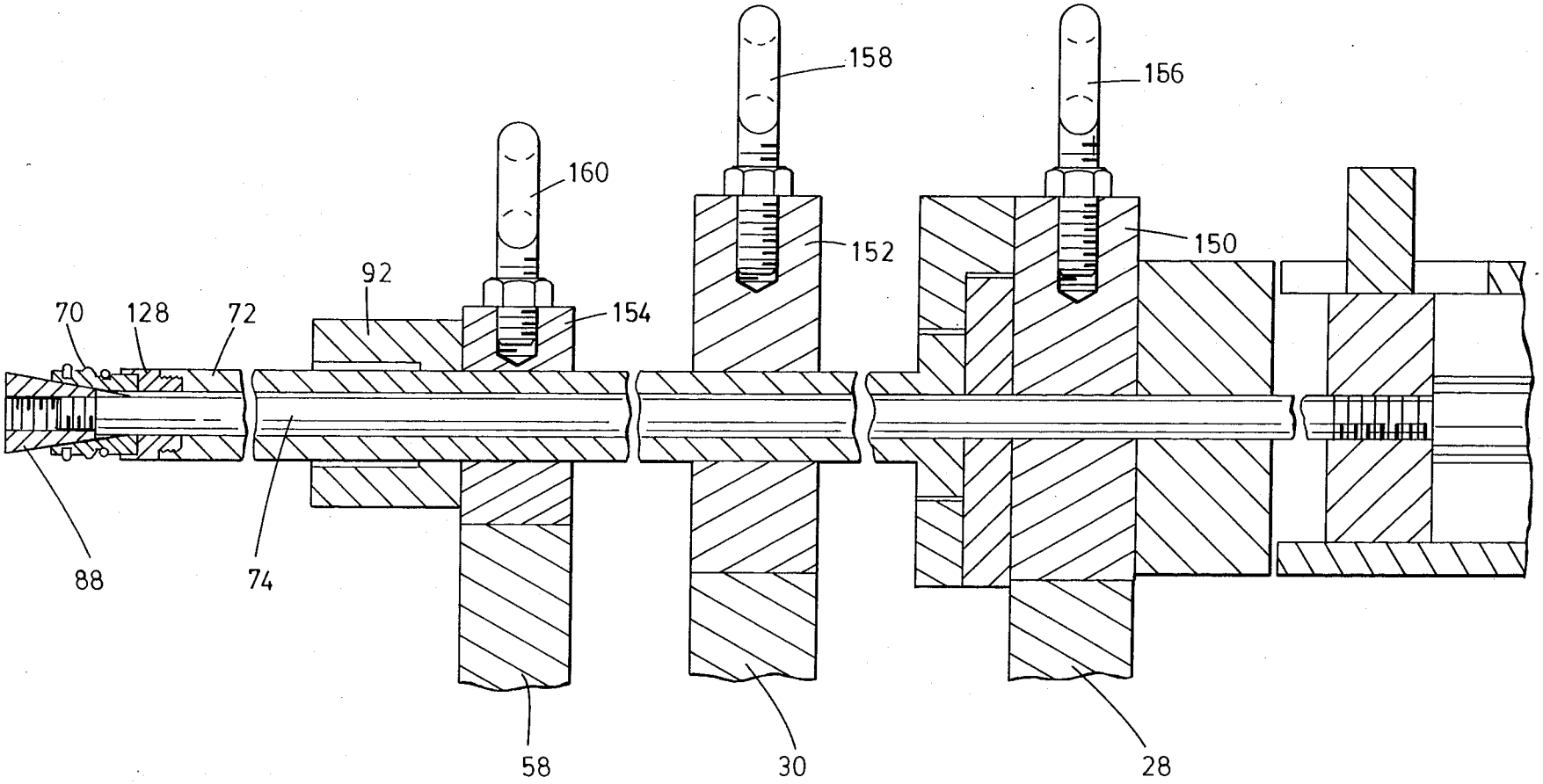
FIG. 6 is a cross-section view of the punch and punch driving structure of the preferred machine, taken along line 6—6 in FIG. 1.

Finishing with FIGS. 1, 4 and 6, the plates 28, 30 and the plate of the second workpiece positioner 58 each include a removable keyed insert, respectively 150, 152, 154. The inserts 150, 152, 154 support the barrel 72, punch segment holder 128, punch segments 70, wedge 88 and wedge drive rod 74 as a machine punch subassembly. Whenever this punch subassembly or any component becomes broken or worn, or for routine maintenance, the hook eyes 156, 158, 160 can be used to pull the inserts from the plates, and thereby pull the punch subassembly from the machine as a unit. A waiting, second punch subassembly can then be inserted, for resumed machine operation while the first punch subassembly is repaired.

The preferred embodiment and the invention are now described in such full, clear, concise and exact terms as to enable a person of skill in the art to make and use the same. To particularly point out and distinctly claim the subject matter regarded as invention, the following claims conclude this specification.

What is claimed is:

1. Apparatus comprising:

a base;

first ways on the base defining an axial direction, the first ways extending axially;

a die and first workpiece component holder movably mounted on the first ways and movable between an operative position and a retracted position;

a die on the die and first workpiece component holder;

a punch holder on the base including an axially extending barrel;

a drive rod extending axially within the barrel;

a wedge on the drive rod, the wedge extending from the barrel toward the and first workpiece component holder;

a plurality of punch segments circumferentially spaced about the wedge having guided members, means for positioning a workpiece, said means for positioning being movably mounted about said punch holder whereby a workpiece may be positioned to engage said punch segments;

automatic drive means on the base for axially reciprocating the drive rod and wedge between a punch engaging position and a non-engaging position, the wedge in the punch engaging position driving the punch segments radially outward;

means on the base for automatically reciprocating the die and first workpiece component holder in coordination with the drive means, the die and first workpiece component holder in the operative position locating the die and first workpiece component for the punch segments to engage the first workpiece component against the die, whereby a first workpiece component loaded in the die and first workpiece component holder is held, reciprocated into operative position with the die while the punch segment are driven radially outward to engage the first workpiece component against the die, the first workpiece component thereby being deformed by the punch segments and die said apparatus further comprising, on the barrel adjacent the punch segments, a second workpiece component holder and means to locate said second workpiece component holder relative to said first component holder, whereby a second workpiece component is deformed with the first workpiece component.

2. Apparatus as in claim 1 further comprising means for releasing the first workpiece component from the die and first workpiece component holder after deformation.

3. Apparatus as in claim 1 further comprising control means operatively connected to the reciprocating means the drive means for coordinating action of the reciprocating means and drive means.

4. Apparatus as in claim 1, wherein the first workpiece component includes a plate and flange, and the die and workpiece component holder includes a plate holder, radially movable die segments, and means for moving the die segments radially inward into forming position in contact with the flange.

5. Apparatus as in claim 4, wherein the means for moving the die segments comprising a chuck having jaws with the die segments thereon, means on the chuck for driving the jaws inward, and means on the chuck for limiting inward travel of the chuck jaws to the forming position.

6. Apparatus as in claim 5 further comprising control means operatively connected to the reciprocating means, the drive means and the means on the chuck, for coordinating action of the reciprocating means, the drive means the means on the chuck.

7. Apparatus as in claim 1 wherein the punch holder, barrel, drive rod, wedge, punch segments and punch segment holder are removable from the apparatus unit.

8. An apparatus comprising:

a base;

first ways on the base defining axial direction, the first ways extending axially;

a die and first workpiece component holder including a plate holder, radially movable die segments, a chuck having jaws with said die segments thereon, means on the chuck for driving the jaws inward, and means on the chuck for limiting inward travel of the chuck jaws in the forming position, movably mounted on the first ways between an operative position and a retracted position;

a punch holder on the base including an axially extending barrel;

a drive rod extending axially within the barrel;

a wedge on the drive rod extending from the barrel toward the die and first workpiece component holder;

a plurality of punch segments circumferentially spaced about the wedge and having guided members;

a punch segment holder on the barrel having a guided members, the guided members of the punch segments being guided in a radial direction by the guide members;

a spring fitted around the punch segments securing said segments to each other and against the wedge;

drive means on the base for axially reciprocating the drive rod and the wedge between a punch engaging position and a non-engaging position, the wedge in the punch engaging position driving the punch segments radially outward;

a controller and a set of drive elements operatively connected to said controller, said drive elements positioned to axially reciprocate said die and first workpiece component holder along said first ways in coordination with the movement of said drive rod and wedge, the die and first workpiece component holder in the operative position locating the die and first workpiece component for the punch segments to engage the first workpiece component against the die, whereby a first workpiece component loaded in the die and first workpiece component holder is held, reciprocated into operative position with the die while the punch segments are driven radially outward to engage the first workpiece component against the die, the first workpiece component thereby being deformed by the segments and the die, said apparatus further comprising, on the barrel adjacent the punch segments, a second workpiece component holder and means to locate said second workpiece component holder relative to said first component holder, whereby a second workpiece component is deformed with the first workpiece component.

9. Apparatus as in claim 8 further comprising means for releasing the first workpiece component from the die and first workpiece component holder after deformation.

10. Apparatus as in claim 8, wherein the punch holder, barrel, drive rod, wedge, punch segments and punch segment holder are removable from the apparatus as a unit.

11. An apparatus comprising:

a base;

first ways on the base defining an axial direction;

a die and workpiece component holder adapted top engage a first workpiece movably mounted on the first ways and movable between an operative position and a retracted position;

a die on the die and workpiece component holder;

a punch holder on the base including an axially extending barrel;

a drive rod extending axially with the barrel;

a wedge on the drive rod the wedge extending from the barrel toward the die and first workpiece holder;

a plurality of punch segments circumferentially spaced about the wedge and having a guided members;

a punch segment holder on the barrel having guide members, the guided members of the punch segments being guided in radial movement by the guide members;

adjustable positioning means for positioning a second workpiece about the barrel, the wedge and the wedge drive rod;

means to locate said second workpiece relative to said first workpiece;

means on the base for moving the die and workpiece holder from the retracted position to the operative position;

drive means on the base for axially reciprocating the drive rod and wedge between a punch engaging position and a non-engaging position, said drive means coordinated with the means for moving the die and first workpiece holder, the wedge in the punch engaging position driving the punch radially outward when the die and first workpiece are in the operative position, thereby joining the first workpiece to the second workpiece to create a joined workpiece;

means for moving the die and workpiece component holder from the operative position to the retracted position after wedge has been returned to the non-engaging position; and means for automatically removing the workpiece from the die and first workpiece joined holder when said die and first workpiece component holder are in the retracted position.

* * * * *